United States Patent [19]

Foster

[11] 4,181,299

[45] Jan. 1, 1980

[54] SPRING POWERED SWING

[76] Inventor: Edwin E. Foster, 1801 Camp Craft Rd., Austin, Tex. 78746

[21] Appl. No.: 867,674

[22] Filed: Jan. 9, 1978

[51] Int. Cl.[2] ..... A63G 9/16

[52] U.S. Cl. ..... 272/86

[58] Field of Search ..... 272/86, 85; 297/273, 297/274, 280; 248/165, 168; 108/20, 149

[56] References Cited

U.S. PATENT DOCUMENTS

| | | | |
|---|---|---|---|
| 803,838 | 11/1906 | Mellen | 272/86 |
| 2,787,948 | 4/1957 | Mathis | 99/421 TP |
| 3,342,484 | 9/1967 | Christensen | 272/62 |
| 3,692,305 | 9/1972 | Allen | 272/86 |
| 3,806,117 | 4/1974 | Foster | 272/86 |

*Primary Examiner*—Richard C. Pinkham
*Assistant Examiner*—T. Brown
*Attorney, Agent, or Firm*—Kalish & Gilster

[57] ABSTRACT

A spring powered swing incorporating a frame supporting a swing seat for to and fro movement, a spring motor assembly within a sealed enclosure and having a male coupling head detachably engageable with a female component formed on said swing; there being a crank-controlled escapement provided with said spring motor assembly productive of incremental release of power stored in said spring. The swing seat support and the escapement crank are operatively detachably interengageable.

21 Claims, 11 Drawing Figures

FIG. 6
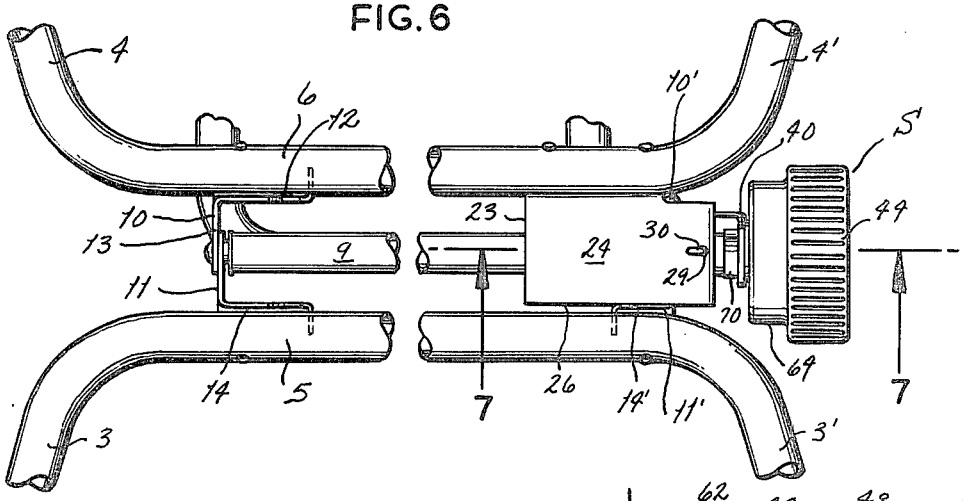
FIG. 7
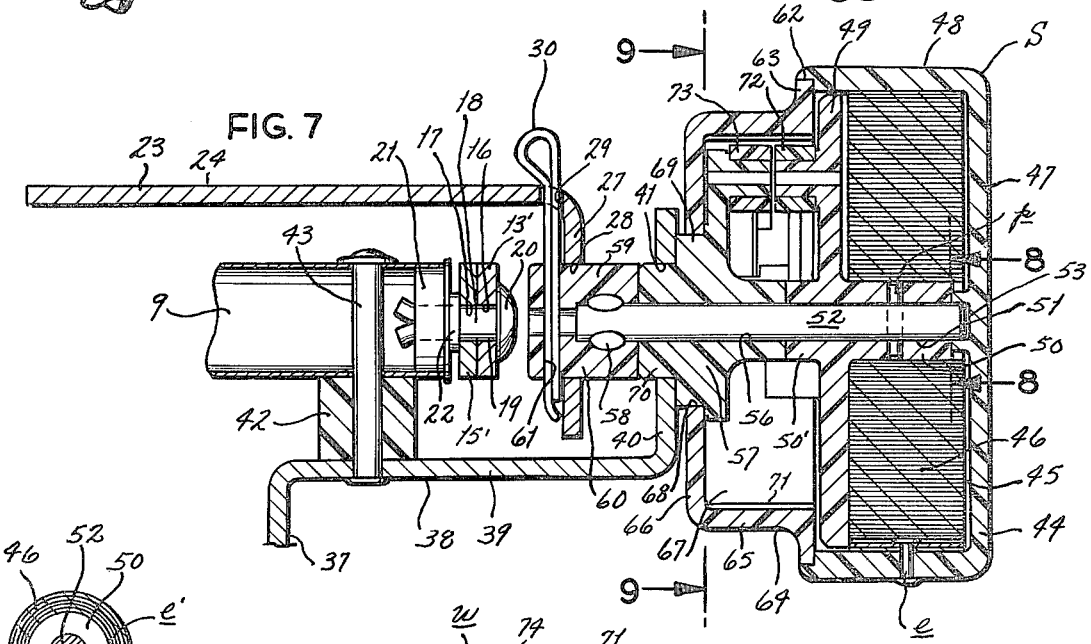
FIG. 8
FIG. 9

SPRING POWERED SWING

BACKGROUND AND SUMMARY OF THE INVENTION

This invention relates in general to swings and, more particularly, to a swing powered by a spring motor.

Heretofore there have been numerous efforts to develop swings which are operated by a spring motor for the intended purpose of causing the swing to operate continuously over a relatively extensive period of time without the frequent intervention of an attendant. Motor driven swings may be exemplified by the structures shown in various of the Saint Patents, such as U.S. Pat. Nos. 3,071,339; 2,979,734 and 2,807,309, but these structures have permitted operation for but limited periods of time before restressing the particular spring which was of the elongated coil type and required frequent winding with the exertion of substantial force. Admittedly, such prior art devices were not designed for facile spring replacement without a substantial disassembly of the entire swing so that such units had recognized limitations which militated against their broad acceptance. A more recent construction is disclosed in the Meade U.S. Pat. No. 3,459,423 but which also was deficient in providing the longevity of unattended swinging movement by utilization of a coiled spring wound by means of the conventional crank and with the spring so integrated as to deny facile spring replacement. Also demonstrative of the state of the art are the patents to Foster, U.S. Pat. Nos. 3,420,523 and 3,806,117, neither of which reveal a readily replaceable spring motor assembly, nor unique coupling means between the spring motor and the swing seat. Additionally, the prior art swings, as indicated, were of an integrated character incorporating frame components which, in addition to adding to the cost, as well as the weight of the unit, restricted the useful life of the swings to coincide with the effective life of the embodied spring.

Therefore, it is an object of the present invention to provide a spring powered swing which is reliable in operation and entirely safe for utilization by children of tender years without supervision.

It is another object of the present invention to provide a swing of the character stated which incorporates a simplicity of coacting mechanical elements cooperating to constitute a self-contained unit which is thus independent of the application of extrinsic motive means so that the swing may be positioned at any location convenient for usage.

It is a still further object of the present invention to provide a swing of the character stated which incorporates a spring powered motor which is readily mountable upon the swing and is easily demountable therefrom as for inspection, repair, storage, etc. without requiring any disassembly of the swing frame.

It is a still further object of the present invention to provide a spring powered swing wherein the motor may be replaced by the average home owner without the necessity of complex tools or developed skill.

It is a still further object of the present invention to provide a swing of the character stated wherein the swing may be manually operated with the motor fully detached so that removal of the motor does not cause any weakening or instability to develop in the frame.

It is another object of the present invention to provide a swing of the character stated which comprehends a swing frame which is devoid of the customary head-forming housing heretofore customarily utilized to integrate swing frames, while concurrently inhibiting access to covered components for inspection or the like.

It is a still further object of the present invention to provide a swing of the character stated which may be most economically manufactured; which incorporates novel escapement means for periodic release of limited increments of spring energy so that a relatively extensive operational period is provided; and which swing is extremely durable in operation.

In essence, the present invention constitutes a novel, sturdy, collapsible frame for supporting, when in operative position, a child-supporting seat for swinging, or to and fro movement, through causing rocking of a crank mounted on a shaft detachably engaged upon the frame and unitarily integrated with a spring motor, said latter being fully enclosed for protection against inadvertent accident, as well as accumulation of life-shortening dirt and foreign matter.

Other objects and details of the present invention will be apparent from the following description when read in connection with the accompanying drawings.

BRIEF DESCRIPTION OF THE DRAWINGS

FIG. 6 is a fragmentary top plan view of the swing.

FIG. 7 is a vertical transverse sectional view taken on the line 7—7 of FIG. 6.

FIG. 8 is a vertical transverse sectional view taken on the line 8—8 of FIG. 7.

FIG. 9 is a vertical transverse sectional view taken on the line 9—9 of FIG. 7, illustrating the keeper pawl in engaged condition.

DESCRIPTION OF THE PREFERRED EMBODIMENT

Figure 1:
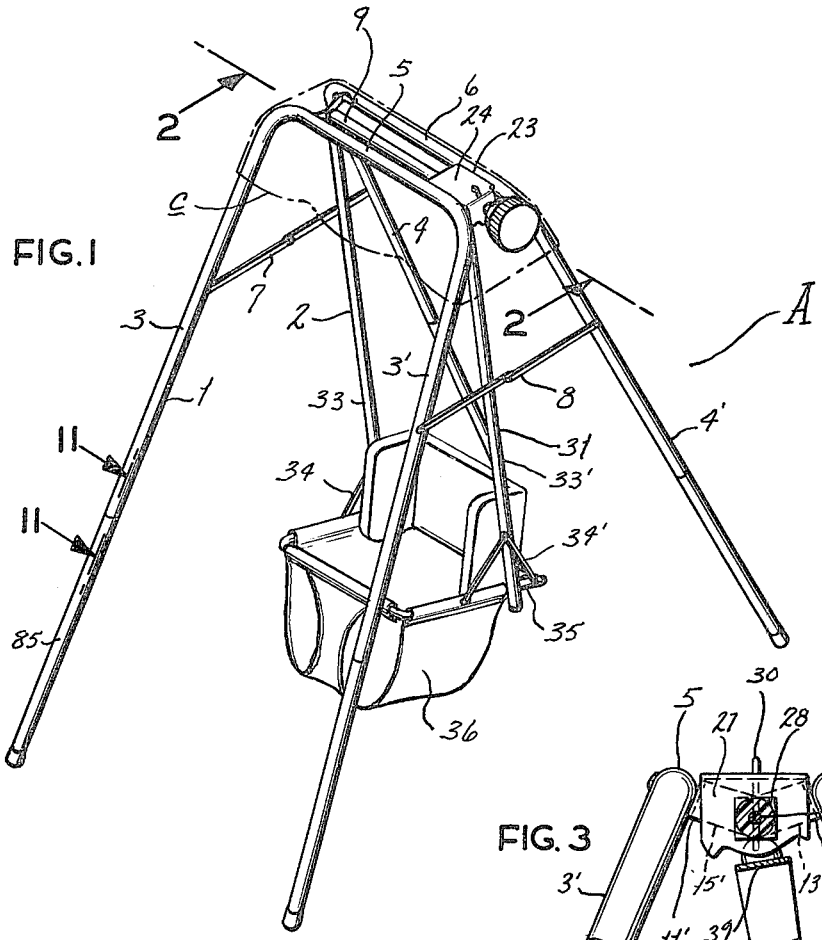
FIG. 1 is a perspective view of a spring powered swing constructed in accordance with and embodying the present invention.

Referring now by reference characters to the drawings which illustrate the preferred embodiment of the present invention, A designates a swing incorporating a support structure including a pair of front and back U-shaped frames 1,2, respectively; each having a pair of legs 3,3′ and 4,4′, respectively, which pairs are interconnected in their upper end portions by transverse elements 5,6, respectively; said latter being axially parallel. Each of said frames 1,2 are fabricated preferably of hollow metal stock to provide a desired sturdiness and yet be of limited weight for ease of transportability of said swing A. Legs 3,4 and 3′, 4′ are interconnected in their upper portions by the usual hinged cross braces 7,8, respectively.

Figure 3:
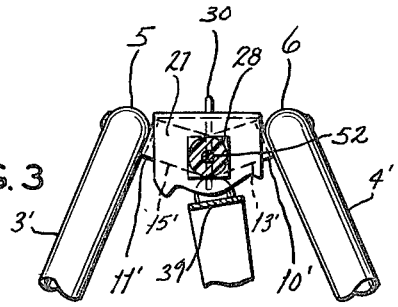
FIG. 3 is a fragmentary vertical transverse sectional view taken on the line 3—3 of FIG. 2.
Figure 2:
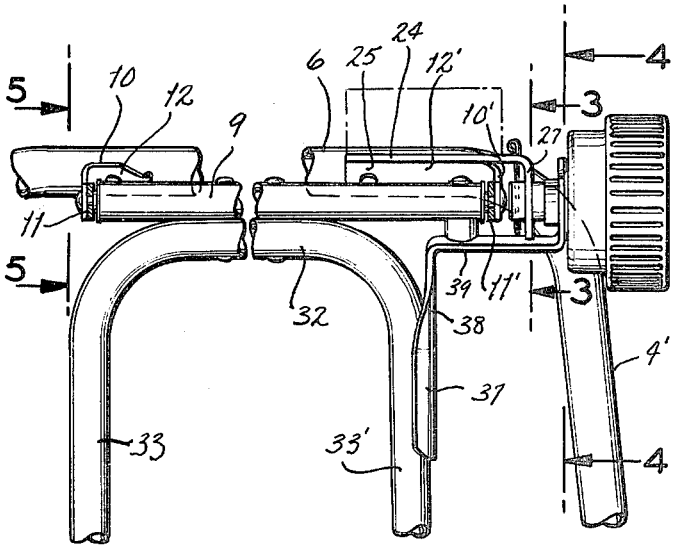
FIG. 2 is an enlarged fragmentary horizontal transverse view taken on the line 2—2 of FIG. 1.
Figure 4:
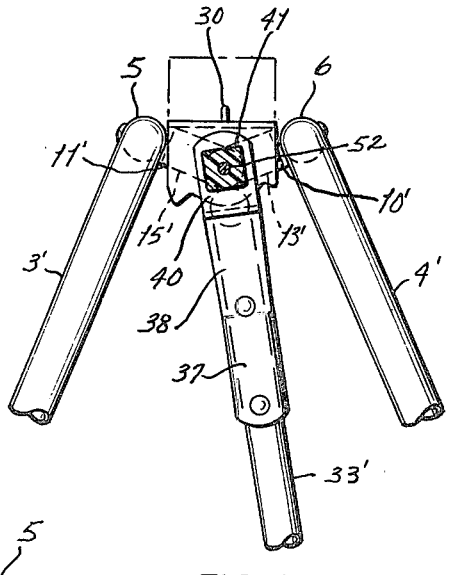
FIG. 4 is a vertical transverse sectional view taken on the line 4—4 of FIG. 2.
Figure 5:
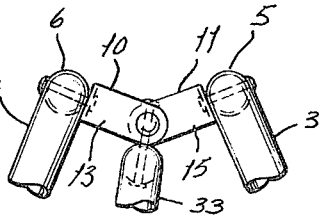
FIG. 5 is a fragmentary end view taken on the line 5—5 of FIG. 2.

Presented between transverse elements 5,6 in axially parallel relationship thereto, but of relatively reduced length, is a rock or swing shaft 9 being maintained spacedly from each of said elements 5,6 by cooperating pairs of hinge brackets 10,11 and 10', 11'. Hinge brackets 10,10' are of general L-shape having their distal legs 12,12', respectively, fixed to said transverse element 6 along its inner or normally forward side and with their other or proximal legs 13,13' extending toward the opposed transverse element 5. Similarly, hinge brackets 11,11' each incorporate distal legs 14,14' affixed securely, as by rivets or the like, to the normally rearward face of transverse element 5 and with their other or proximal legs 15,15' extending toward transverse element 6. The end portions of hinge legs 13, 15 and 13', 15' are in overlapping relationship (see FIG. 6) for registration of apertures 16,17 formed therein (see FIG. 7) for extension therethrough of the stem 18 of a fastening member such as a rivet 19, the enlarged outer head 20 of which abuts against the outer end face of the adjacent hinge leg 13,13' as the case may be. Said rivet 19 extends through a closure or plug 21 provided in the adjacent end of shaft 9 and suitably retained against undesired axial displacement. A spacer 22 is disposed between said engaged hinge legs and shaft 9 to prevent any untoward binding effect. It will thus be seen that rivets 19 thus constitute a hinge axis about which shaft 9 is rockable. Hinge brackets 11,11' are relatively swingable with respect to cooperating hinge brackets 10,10' to accommodate the relative movement of said transverse elements 5,6 as the swing frame is moved from open condition (FIG. 1) to collapsed condition for compaction. It will be seen that hinge brackets 10,10', 11, 11' serve to support shaft 9 while also acting to rigidify the swing frame and to assure of appropriate relative spacing of transverse elements 5,6. As may be best observed in FIGS. 2, 3 and 4 hinge bracket 10' is integrally formed from a support member 23 comprising a top plate portion 24, having a depending flange 25 which in part constitutes leg 12' of hinge 10' for fixed securement to the adjacent portion of transverse element 6. Along its opposed or forward edge, said plate 24 is free, as at 26, for abutting against the forward transverse element 5 when said swing is in extended or operative position thereby providing enhanced stability to swing A as against inadvertent or accidental collapse. Said plate 24 may, if desired, provide a support for a music box (not shown) (if desired). Support member 23 is of such length as to cause top plate portion 24 to extend endwise of swing A spacedly beyond the proximate end of shaft 9 and in such end extremity is turned down to provide a flange 27 which terminates below said shaft 9 (see FIG. 7). Flange 27 is provided with an enlarged quadrilateral, preferably square, aperture 28, the center of which is aligned with the axis of shaft 9, for purposes presently appearing. There is also formed in top plate 24 immediately adjacent flange 27 an opening 29 for extension downwardly therethrough of a fastener, such as a cotter pin, 30, for purposes to be described below.

Fixed to shaft 9 in dependency therefrom and for swinging therewith is a seat support 31 having an upper cross member 32 riveted or otherwise fixed to the normally underside of shaft 9 and a pair of depending hanger rods 33,33' which at their lower ends are suitably engaged, as in a conventional manner, to the opposed side portions 34,34', respectively, of a rigid seat support frame 35 which is adapted for detachably receiving the usual flexible baby-retaining seat 36 as fabricated of canvas, plastic or the like. It is apparent that upon rocking of shaft 9 about its axis the seat 36 will be caused to swing forward and backward in the usual manner.

Affixed to the upper outer lateral portion of hanger rod 33' is a complementarily arcuated mounting flange 37 of a crank coupler 38 which incorporates a horizontally presented, laterally outwardly extending arm 39, being downwardly spaced from the adjacent end portion of shaft 9, thence spacedly beneath the bottom edge of flange 27 and laterally outwardly thereof is turned upwardly presenting a vertical extension 40 having an enlarged quadrilateral opening 41 of like contour and dimension as aperture 28 with which it is fully registrable. For assuring of reliable alignment of said opening 41 and aperture 28, a spacer 42 is held between arm 39 and shaft 9, as by means of an elongated rivet 43 (see FIGS. 2 and 7). Thus by reason of the securement of flange 37 to hanger rod 33', and the engagement of arm 39 to shaft 9 through rivet 43, crank coupler 38 is rendered reliably stable for reasons more fully developed hereinbelow.

The motive power for rocking of shaft 9 is a spring motor assembly S comprising a casing 44 having an annular compartment 45 within which is received a spring motor 46 which may preferably be of the spiral type being formed of flat ribbon stock and tensioned to produce residual stresses for causing said spring to form a spiral coil composed of a plurality of tightly wound convolutions. Said spring may be of the compound curved type as disclosed in Foster U.S. Pat. Nos. 3,363,891 and 3,738,634. Compartment 45 is defined by the outer circular wall 47 of casing 44 and a continuous side wall 48; with closure being effected on its inner or swing adjacent side by a plate 49. Integrally formed with plate 49 is an arbor 50 projecting axially of compartment 45 and about which the coil of spring 46 is disposed. The normally outer end of spring 46 is affixed to side wall 48 as by a rivet e and with the other or normally inner end of said spring 46 being secured to arbor 50, as at e' (FIG. 8). Thus, in wound condition spring 46 will be tightly disposed about arbor 50 which forms a hub and in unwound condition will spirally come to rest against the inside face of casing side wall 48. It is to be understood that other types of spiral springs, including clock springs, may be utilized in the present invention, although the aforesaid compound curve springs with their substantial power, durability and capacity to expend force in a relatively constant manner render the latter as preferred motors. Arbor 50 together with a relatively short extension, as at 50', on the opposite side of plate 49 is bored, as at 51, for reception of a shaft 52 which latter is secured to arbor 50, as by a pin p, so as to inhibit relative movement between said shaft 52 and said arbor and the integrated plate 49. Shaft 52 projects beyond the outer end of arbor 50 for journalling in a bearing 53 provided centrally on the inner face of wall 47 of casing 44. For purposes to be described more fully hereinbelow, casing 44 is rotatable about shaft 52 for spring winding purposes, there being no interference with plate 49.

Shaft 52 progresses beyond arbor extension 50' toward the frame of the swing for extension through an aligned bore 56 formed within a crank, designated 57, which latter for purposes presently appearing is relatively rockable about the stationary shaft 52. In its inner end extremity shaft 52, beyond crank 57, incorporates circumferentially spaced ears, as at 58, for embeddment within the inner circular portion 59 of mounting head 60, which is of like contour and of substantially the same cross sectional dimension as aperture 28 for relatively fitted extension therethrough. By reason of the four-sided character of said aperture and the engaged portion of mounting head 60, the same are held against relative movement so that shaft 52 is rendered stationary through the aforesaid pin p and the embeddment of ears 58 within head 60. At its inner end inwardly of flange 27, head 60 is provided with a vertical bore 61 aligned with opening 29 for receiving the fastener or cotter pin 30 whereby spring assembly S is locked to the swing frame through support member 23 so that accidental detachment or removal of spring assembly S from the swing frame is inhibited.

Side wall 48 of casing 44 along its inner edge is provided with a recess, as at 62, for accepting a peripheral flange 63 formed at the outer end of a cooperative housing 64 having a circular side wall 65 of slightly reduced diameter relative to casing wall 48 and with there being a vertical end wall 66 in substantially planar parallel relationship to casing wall 47. Housing 64 cooperates with the spring-remote face of plate 49 to form a chamber 67 wherein crank 57 is substantially disposed. Casing 44 and housing 64 are integrated by suitable treatment, depending upon the material of construction, so as to be united into a unitary enclosure which may be rotated about shaft 52 during the spring winding and unwinding action and the enclosure suitably protects the contained spring and ratchet and pawl assembly, to be described, in a protected state, proof against introduction of dirt, grease, foreign matter and the like as well as being inhibitory of impulses toward hampering. Within end wall 66 is a circular opening 68 for receiving a cylindrical component 69 of said crank 57; which opening 68 serves as a bearing for crank 57 so that the latter is rockable about shaft 52 independently of the enclosure of which housing 64 is a portion. Crank 57 also integrally embodies a quadrilateral extension 70 which also is of like contour and substantially identical cross sectional dimension as opening 41 in crank coupler extension 40 for fixed reception therein and for movement therewith. Accordingly, as will be discussed more fully hereinbelow swinging movement of swing seat support 31 will effect concurrent corresponding rocking of crank 57 by reason of the unique, but readily detachable interconnection between crank coupler 38 and extension 70.

Figure 10:
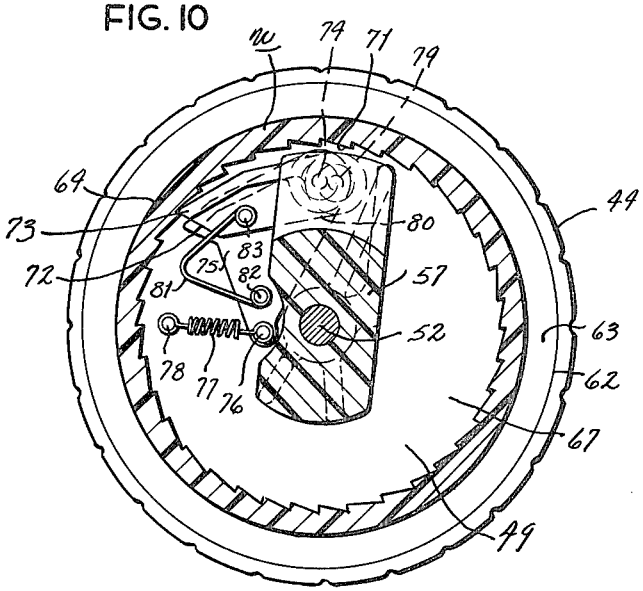
FIG. 10 is a vertical transverse sectional view taken substantially on the line 9—9 of FIG. 7, but illustrating the driver pawl in engaged condition.
Figure 11:
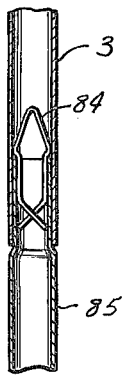
FIG. 11 is a vertical sectional view taken on the line 11—11 of FIG. 1.

With particular reference to FIGS. 7, 9 and 10, it will be seen that the inner face of housing side wall 65 is provided throughout its extent with ratchet teeth 71, in effect developing an internal ratchet wheel w integral as aforesaid with the combined enclosure of casing 44 and housing 64. Ratchet teeth 71 are presented for engagement with a keeper pawl 72 and a driver or indexing pawl 73, disposed within chamber 67 and for cooperative action as will be described whereby spring 46 is incrementally released from fully wound condition. Thus, as will be shown said pawls 72,73 and ratchet wheel w coact to provide a desired escapement productive of a relative extended period of continuous swinging of seat support 31 without the intervention of the services of an attendant.

Keeper pawl 72 is swingably mounted by means of a pivot pin 74 extending from the adjacent face of plate 49 and said pawl 72 integrally contains a depending extension 75 which latter in its lower portion carries a small boss 76 to which is anchored one end of a short coil spring 77, the opposite end of which is fixed to a pin 78 integral with plate 49 and extending axially normal thereto. Spring 77 thus tends to restrain movement of keeper pawl 72 in a generally clockwise manner (as viewed in FIG. 9) about pivot pin 74. Keeper pawl 72 is disposed for engaging teeth 71 in the upper portion of ratchet wheel w in order to prevent premature reverse rotation of said wheel w and, hence, of the closure as in accordance with common structure the said teeth 71 will ride over keeper pawl 72 as torque is applied to the said enclosure during winding of spring 46.

Driver pawl 73 is pivotally disposed by a pin 79 formed on the normally upper end of an arm 80 integral with crank 57 which arm projects upwardly of component 69 within chamber 67 and is in axially perpendicular relationship to shaft 52. Said arm 80 thus presents driver pawl 73 at a predetermined radial distance from the axis of shaft 52 causing said driver pawl 73 to be in substantially side by side relationship with keeper pawl 72, but yet permitting of appropriate indexing action for sequential release of keeper pawl 72 for purposes presently appearing. It will thus be seen that driver pawl 73, being integrated with crank 57, will have a rocking component imparted thereto as said crank is rotated upon swinging of said support 31 by reason of the union between crank coupler 38 and extension 70. Driver pawl 73 in its free end or pin-remote end portion is interconnected with keeper pawl 72 by a compression spring 81 extending between mounts 82,83 respectively provided upon said pawls 72,73 for coordinating the relative movement therebetween.

From the foregoing the operation of the present invention should be apparent. With seat support 31 in stationary position, spring 46 is wound tightly about arbor 50 through rotation of the combined casing-housing enclosure during which keeper pawl 72 will progressively slide past ratchet teeth 71 as the same are moved in a counterclockwise position as viewed in FIG. 9; such action continuing until spring 46 is fully wound about arbor 50 in which condition manifestly maximum energy has been stored and premature or inadvertent release of such energy is prevented by engagement of keeper pawl 72 within the proximate ratchet tooth 71 through urging of spring 77. During this winding period driver pawl 73 will be out of engagement with the teeth of ratchet wheel w by reason of the disposition of crank 57 and, hence, arm 80 which, as indicated, is controlled by the stationary character of seat support 31. The operator will then give seat support 31, or seat 36, as the case may be, a slight forward starting push as toward the left hand side of FIG. 1 causing crank 57 to be swung so that driver pawl 73 will be moved rearwardly of keeper pawl 72 and thereby engage ratchet teeth 71 while concurrently through action of the aforesaid springs effect removal of keeper pawl 72 from engagement with said teeth 71. Then as the swing moves rearwardly, driver pawl 73 is withdrawn from such engagement with ratchet teeth 71 and keeper pawl 72 restored to engagement but with the next successive tooth by reason of the momentary loss of engagement through the aforesaid action of driver pawl 73. Thus, this alternating engaging and disengaging of keeper pawl 72 will be continued through this periodicity of the swinging of seat support 31 until spring 46 has become completely unwound. The relationship of pawls 72,73 thus allow for controlled escapement of ratchet wheel w for release of a predetermined increment of energy or power from the normally backwound spring motor 46 to assure of continuing swinging action. Accordingly, the swinging operation of seat support 31 will continue on a to and fro basis with ratchet wheel w alternating between restraint and release so that swinging will continue until motor 46 has been fully wound about the inner face of casing wall 48 unless, for instance, the unwinding is intentionally stopped in which case the operation will be discontinued in the middle of a cycle of movement until restarted.

From the foregoing it is readily apparent that the entire spring assembly S is readily detached from the swing by simple withdrawal of cotter pin 30 and then outward pulling upon said assembly to remove mounting head 60 from the aperture 28 and thence through opening 41. Through such simplicity of interengagement of spring assembly S with the swing, a entire new spring motor assembly S could be installed within literally a matter of seconds and with there, of course, being no necessity of resort to extrinsic tools or modification in any way of the entire frame assembly of the swing. Spring assembly S is thus an entirely self-contained unit and through the novel interengagement between crank 57 and crank coupler 38 is reliably brought into operational relationship with seat support 31 without even the necessity of close inspection by the user. As indicated above, shaft 52 and shaft 9 are coaxial thereby conducing to but a single major axis of rotation as well as facilitating manufacture by reason of alignment of mounting head 60 and extension 70 for facile engagement within their cooperating female coupling elements.

If desired, a flexible covering, indicated at c, may be placed upon the upper end of swing A for ornamental purposes.

Also, the lengths of legs 3,3' may be suitably controlled by the provision of extensions 85 which are engageable by well known spring members 84 designed for frictional engagement.

Having described my invention what I claim and desire to obtain by Letters Patent is:

1. A swing comprising a frame, said frame having components spaced apart in the upper portion thereof, a rock shaft presented in the spacing between said frame components and engaged to said frame for axial rockable movement, a body-support structure secured to said rock shaft and depending therefrom for to and fro swinging movement, a mounting plate secured on said frame and having an extended portion presented spacedly from, beyond, one end of said rock shaft, a spring motor assembly comprising a housing and a spring disposed within said housing for energy-storing winding and energy-releasing unwinding movement, a first mounting means projecting from said housing, a second mounting means provided on said mounting plate extended portion for cooperatively engaging said first mounting means in locking relationship therewith, and means for interengaging said first mounting means and said mounting plate when said first and second mounting means are in locking relationship whereby said spring motor assembly may be optionally mounted upon, or demounted from, said frame.

2. A swing as defined in claim 1 and further characterized by said first mounting means being a male member and said second mounting means being a female member of complementary cross-section and contour to said male member for extension therethrough of said first mounting means for locking relationship said male member having a portion thereof extending a predetermined distance beyond said female member.

3. A swing as defined in claim 2 and further characterized by said mounting plate having an aperture spaced from said second mounting means, said male member having an opening in said portion projecting beyond said female member when in locking relationship therewith and being registrable with said mounting means aperture when interengaged with said female member, and said means for detachably interengaging said male and female members being a fastener accepted within said mounting means aperture and said male member opening.

4. A swing as defined in claim 3 and further characterized by said fastener being a cotter pin.

5. A swing as defined in claim 1 and further characterized by escapement means provided in said spring housing for incremental release of energy stored by said spring when in wound condition.

6. A swing as defined in claim 5 and further characterized by means structurally independent of said first and second latching elements operatively interconnecting said body-support structure and said escapement means whereby operation of the latter when the spring is in wound condition is initiated by impartation of a rocking to said body-support structure.

7. A swing as defined in claim 6 and further characterized by said means operatively interconnecting said body-support structure and said escapement means being spaced from the proximate end of said rock shaft.

8. A swing as defined in claim 5 and further characterized by means operatively interengaging said body-support structure and said escapement means comprising a crank, means supporting said crank within said spring housing for rockable movement of said crank about an axis coincident with, but spaced from, the axis of said rock shaft, and coupling means on said body-support structure engaging said crank.

9. A swing as defined in claim 8 and further characterized by said coupling means comprising a crank coupler carried on said body-support structure and having a receptacle-forming portion, an extension provided on said crank and projecting beyond said housing and engaging said receptacle-forming portion of said crank coupler thereby operatively interconnecting said body-support structure.

10. A swing as defined in claim 8 and further characterized by said means within said housing for rockable movement of said crank comprising a shaft, means attaching said shaft to one end of said spring, said crank being rockably mounted on said shaft, and means attaching said first mounting means to an end of said shaft remote from said shaft attaching means said spring.

11. A swing as defined in claim 10 and further characterized by said escapement means comprising a ratchet wheel adjacent said spring, a keeper pawl for engaging said ratchet wheel to prevent premature rotation thereof pursuant to unwinding of said spring, and a driver pawl carried on said crank and engageable with said ratchet wheel to permit intermittent disengagement of said keeper pawl from said ratchet wheel during swinging of said support structure whereby said spring stored energy is incrementally released.

12. A swing as defined in claim 10 and further characterized by said first mounting means being a mounting head of quadrilateral contour, and said second mounting means element being an aperture of substantially like cross-sectional area and contour as said mounting head for receiving same preventive of relative rockable movement of one with respect to the other.

13. A swing comprising a frame, a support structure swingably secured to said frame and depending therefrom and rockably movable about an axis transverse of said frame, a body receiving member carried on said support structure for movement therewith, a spring motor assembly detachably mounted upon said frame and comprising an enclosure, a spring disposed within said enclosure and adapted for energy-storing winding and energy-releasing unwinding movement, a first cooperative component provided on said enclosure, a second cooperative component provided on said frame for receiving said first cooperative component, means for detachably interengaging said first and second cooperative components whereby said spring motor assembly may be optionally mounted upon, or demounted from, said frame, escapement means provided in said enclosure for incremental release of energy stored by said spring when in wound condition, means operatively interconnecting said support structure and said escapement means whereby operation of the latter is initiated by rocking of said support structure, said means operatively interengaging said support structure and said escapement means being a crank, a shaft provided within said enclosure for rockable movement of said crank thereon, said shaft being spaced from, but coaxial with the axis of swing of said support structure, coupling means interengaging said crank and said support structure comprising a crank coupler fixed on said support structure and having a first mating portion, a second mating portion provided on said crank for engaging said first mating portion.

14. A swing as defined in claim 13 and further characterized by said means within said housing for rockable movement of said crank comprising a shaft, means attaching said shaft to one end of said spring, said crank being rockably mounted on said shaft, and means attaching said first cooperative component to the other end of said shaft.

15. A swing as defined in claim 14 and further characterized by said escapement means comprising a ratchet wheel adjacent said spring, a keeper pawl for engaging said ratchet wheel to prevent premature rotation thereof pursuant to unwinding of said spring, and a driver pawl carried on said crank and engageable with said ratchet wheel to permit intermittent disengagement of said keeper pawl from said ratchet wheel during swinging of said support structure whereby said spring stored energy is incrementally released.

16. A swing as defined in claim 14 and further characterized by said first cooperative component being a mounting head of quadrilateral contour, and said second cooperative component being an aperture of substantially like cross-sectional area and contour as said mounting head for receiving same preventive of relative rockable movement of one with respect to the other.

17. A swing comprising a frame, a rock shaft provided on said frame in transverse relationship thereto for axial rockable movement, a body-support structure secured to said rock shaft and depending therefrom for to and fro swinging movement, mounting means secured on said frame and having an extended portion presented spacedly from, beyond, one end of said rock shaft, a spring motor assembly comprising a housing and a spring disposed within said housing for energy-storing winding and energy-releasing unwinding movement, escapement means provided in said housing for incremental release of energy stored by said spring when in wound condition, means located spacedly from one end of said rock shaft operatively interengaging said body-support structure and said escapement means, and detachably cooperative interengaging means provided on said frame mounting means and said spring motor assembly whereby said latter may be optionally mounted upon, or demounted from, said frame, said means operatively interconnecting said body-support structure and said escapement means being structurally independent of, and spaced from, said detachably cooperative interengaging means, said last mentioned means being located between and spaced from said rock shaft and said operatively interconnecting means.

18. A swing as defined in claim 17 and further characterized by said means operatively interengaging said body-support structure and said escapement means comprising a crank, means supporting said crank within said spring motor assembly housing for rockable movement of said crank, and coupling means interengaging said crank and said body-support structure.

19. A swing as defined in claim 18 and further characterized by said coupling means comprising a crank coupler carried on said body-support structure and having a receptacle-forming portion, an extension provided on said crank projecting beyond said housing engaging said coupler receptacle-forming portion to thereby operatively interconnect said crank and said body-support structure.

20. A swing as defined in claim 18 and further characterized by said means within said housing supporting said crank for rockable movement comprising a shaft, means attaching said shaft at one end of said spring, said crank being rockably mounted on said shaft, and means exterior of said housing attaching a portion of said cooperatively interengaging means to said shaft remote from said spring.

21. A swing as defined in claim 20 and further characterized by said escapement means comprising a ratchet wheel adjacent said spring, a keeper pawl for engaging said ratchet wheel to prevent premature rotation thereof pursuant to unwinding of said spring, and a driver pawl carried on said crank and engageable with said ratchet wheel to permit intermittent disengagement of said keeper pawl from said ratchet wheel during swinging of said support structure whereby said spring stored energy is incrementally released.

* * * * *

UNITED STATES PATENT AND TRADEMARK OFFICE

CERTIFICATE OF CORRECTION

PATENT NO. : 4,181,299

DATED : January 1, 1980

INVENTOR(S) : Edwin E. Foster

It is certified that error appears in the above—identified patent and that said Letters Patent is hereby corrected as shown below:

Claim 10, column 2, line 53, before "said spring" insert -- to --.

Claim 12, column 2, line 67, delete "element".

Signed and Sealed this

*Fifth* Day of *August 1980*

[SEAL]

*Attest:*

SIDNEY A. DIAMOND

*Attesting Officer*

*Commissioner of Patents and Trademarks*